US007284966B2

(12) United States Patent
Xu et al.

(10) Patent No.: US 7,284,966 B2
(45) Date of Patent: Oct. 23, 2007

(54) MICRO-PUMP

(75) Inventors: Guolin Xu, Singapore (SG); Lin Kiat Saw, Singapore (SG); Dor Ngi Ting, Singapore (SG)

(73) Assignee: Agency for Science, Technology & Research (SG)

( * ) Notice: Subject to any disclaimer, the term of this patent is extended or adjusted under 35 U.S.C. 154(b) by 691 days.

(21) Appl. No.: 10/676,601

(22) Filed: Oct. 1, 2003

(65) Prior Publication Data

US 2005/0074340 A1 Apr. 7, 2005

(51) Int. Cl.
*F04B 43/06* (2006.01)

(52) U.S. Cl. ..... 417/395; 417/413.2

(58) Field of Classification Search ..... 417/395, 417/413.1, 413.2

See application file for complete search history.

(56) References Cited

U.S. PATENT DOCUMENTS

| | | | | | |
|---|---|---|---|---|---|
| 2,980,032 | A | * | 4/1961 | Schneider | 417/395 |
| 3,386,388 | A | * | 6/1968 | Rosenberg | 417/395 |
| 3,424,091 | A | * | 1/1969 | Turner | 417/395 |
| 3,715,174 | A | * | 2/1973 | Davis et al. | 417/413.1 |
| 4,305,702 | A | * | 12/1981 | Hartley | 417/413.1 |
| 5,171,132 | A | * | 12/1992 | Miyazaki et al. | 417/413.1 |
| 5,219,278 | A | | 6/1993 | van Lintel | 417/413 |
| 5,259,737 | A | * | 11/1993 | Kamisuki et al. | 417/413.1 |
| 5,394,840 | A | * | 3/1995 | Phelps | 417/395 |
| 5,499,909 | A | | 3/1996 | Yamada et al. | 417/384 |
| 5,718,567 | A | * | 2/1998 | Rapp et al. | 417/395 |
| 5,725,363 | A | | 3/1998 | Bustgens et al. | 417/413.1 |
| 5,759,014 | A | | 6/1998 | Van Lintel | 417/413.3 |
| 6,033,191 | A | * | 3/2000 | Kamper et al. | 417/413.2 |
| 6,042,345 | A | * | 3/2000 | Bishop et al. | 417/413.2 |

(Continued)

FOREIGN PATENT DOCUMENTS

| | | |
|---|---|---|
| EP | 0789146 | 8/1997 |

(Continued)

OTHER PUBLICATIONS

Maillefer, D. et al., "A high-performance silicon micropump for disposable drug delivery systems", The thirteenth IEEE International Micro Electro Mechanical Systems (MEMS-2000 Conference, Miyazaki, Japan, 413-417.

(Continued)

*Primary Examiner*—Michael Koczo, Jr.
(74) *Attorney, Agent, or Firm*—Carlos A. Fisher; Stout, Uxa, Buyan & Mullins, LLP

(57) ABSTRACT

A micro-pump having a first layer, a second layer and an intermediate flexible layer is disclosed. The first layer and second layer may be of moldable plastics. The intermediate layer may be a substantially flat PDMS membrane layer having an inlet hole and an outlet hole. The first layer and the second layer are disposed on either side of the intermediate layer to define a pumping chamber that encloses an actuatable portion of the intermediate layer and valve seats that abut the inlet hole and the outlet hole of the intermediate layer. The actuatable portion is moveable to increase and reduce the volume of the pumping chamber to allow pressure to lift the respective intermediate layer portions surrounding the inlet hole and the outlet hole to thereby draw fluid and expel fluid from the pumping chamber respectively.

12 Claims, 8 Drawing Sheets

U.S. PATENT DOCUMENTS

| | | | | |
|---|---|---|---|---|
| 6,390,791 | B1 | 5/2002 | Maillefer et al. | 417/413.3 |
| 6,408,878 | B2 | 6/2002 | Unger et al. | 137/597 |
| 6,520,753 | B1 | 2/2003 | Grosjean et al. | 417/379 |
| 2002/0081866 | A1 | 6/2002 | Choi et al. | 438/800 |

FOREIGN PATENT DOCUMENTS

| | | |
|---|---|---|
| GB | 2248891 | 4/1992 |
| WO | 02/43615 | 6/2002 |

OTHER PUBLICATIONS

Khoo, M. et al., "A novel micromachined magnetic membrane microfluid pump", The 22nd Annual International Conference of the IEEE Engineering in Medicine and Biology Society. Chicago, IL, 2000, 1-4.

Linnemann, R. et al., "A self-priming and bubble-tolerant piezoelectric silicon micropump for liquids and gases", The 11th annual international workshop on MEMS, 1998 Heidelberg Germany, 532-537.

Kamper, K.P. et al., "A self-filling low-cost membrane micropump", The 11th annual international workshop on MEMS, 1998 Heidelberg Germany, 432-437.

Shinohara, J. et al., "A high pressure-resistance micropump using active and normally-closed valves", Thirteenth IEEE International Micro Electro Mechanical Systems (MEMS-2000) Conference, Miyazaki, Japan, 2000.

Grosjean, C. et al., "A thermopneumatic peristaltic micropump", Techical Digest of Transducers 99, Sendai, Japan.

Maillefer, D. et al., "A high-performance silicon micropump for an implantable drug delivery system", The 1999 IEEE International Micro Electro Mechanical Systems (MEMS-1999) Conference. Orlando, FL, 1999.

International Search Report for International Application No. PCT/SG2004/000314, which claims priority to the above identified application, and dated Nov. 26, 2004.

* cited by examiner

MICRO-PUMP

BACKGROUND

This invention relates to a micro-pump (or miniature pump) that is suitable for use in biomedical and bio-analytical applications.

Micro-pumps have recently been of interest and found applications, for example, in the life sciences and the pharmaceutical sector. One application is the delivery of drugs to the human body. For this purpose, micro-pumps are worn on the human body or implanted therein. Micro-pumps are also used in bio-analytical or biochemical research.

One of the driving factors for the increase in bio-analysis applications is the completion of the Human Genome Project, which results in the rapid development of molecular diagnostics in the laboratories. Diagnostic systems used in these laboratories include micro-pumps which are essential for micro-fluid manipulation of reagent and fluid samples. These micro-pumps, with integrated micro-valves, are capable of precise and controllable fluid delivery in the range of μl/min to ml/min. To avoid contamination, most components in a diagnostic system, including micro-pumps, are typically disposed after each use. Consequently, a micro-pump for use in such a diagnostic system should ideally be low in cost, reliable and easy to control.

Various types of micro-pumps are available. Some of these micro-pumps are described in U.S. Patent Application 2002/0081866, Choi et al., "Thermally Driven Micro-pump Buried In A Silicon Substrate And Method For Fabricating The Same"; U.S. Pat. No. 6,390,791, Maillefer et al., "Micro Pump Comprising an Inlet Control Member For Its Self-Priming"; U.S. Pat. No. 5,759,014, Van Lintel, "Micro-pump"; U.S. Pat. No. 5,499,909, Yamada et al., "Pneumatically Driven Micro-pump"; U.S. Pat. No. 6,520,753, Grosjean et al., "Planar Micro-pump"; U.S. Pat. No. 6,408,878, Unger et al., "Microfabricated Elastomeric Valve And Pump Systems"; WO 02/43615, Unger et al., "Microfabricated Elastomeric Valve And Pump Systems"; Didier Maillefer et al., "A High-Performance Silicon Micro-pump For Disposable Drug Delivery Systems", *The thirteenth IEEE International Micro Electro Mechanical Systems* (*MEMS*-2000) *Conference*, Miyazaki, Japan; Melvin Khoo et al., "A Novel Micromachined Magnetic Membrane Microfluid Pump", *The 22nd Annual International Conference of the IEEE Engineering in Medicine and Biology Society*. Chicago, IL, 2000; R. Linnemann, P. Woias, C. D. Senffl, and J. A. Ditterich, "A self-priming and bubble tolerant piezoelectric silicon micro-pump for liquids and gases", *The* 11$^{th}$ *annual international workshop on MEMS*. 1998, Heidelberg Germany, pp.532-537; K. P. Kamper, J. Dopper, W. Ehrfeld, and S. Oberbeck, "A self-filling low-cost membrane micro-pump", *The* 11$^{th}$ *annual international workshop on MEMS*. 1998, Heidelberg Germany, pp.432-437; Jun Shinohara et al., "A high pressure-resistance micro-pump using active and normally-closed valves", *Thirteenth IEEE International Micro Electro Mechanical Systems* (*MEMS*-2000) *Conference*. Miyazaki, Japan, 2000; Charles Grosjean et al., "A thermopneumatic peristaltic micro-pump", *Technical Digest of Transducers* '99, Sendai, Japan; and Didier Maillefer et al., "A high-performance silicon micro-pump for an implantable drug delivery system", *The* 1999 *IEEE International Micro Electro Mechanical Systems* (MEMS1999) Conference. Orlando, Fla., USA, 1999.

Some of the micro-pumps generally include a diaphragm in a chamber that is bounded either by two check valves or two nozzle/diffuser configurations. Such micro-pumps are disclosed in U.S. Pat. No. 5,759,014, 6,390,791, and Didier Maillefer et al., "A High-Performance Silicon Micro-pump For Disposable Drug Delivery Systems", *The thirteenth IEEE International Micro Electro Mechanical Systems* (*MEMS*-2000) *Conference*, Miyazaki, Japan. The diaphragm of these micro-pumps is typically fabricated from a silicon wafer using bulk micro-machining or surface micro-machining. Bulk micro-machining is a subtractive fabrication method whereby single crystal silicon is lithographically patterned and then etched to form three-dimensional structures. Surface micro-machining is an additive method where layers of semiconductor-type materials such as polysilicon, silicon nitrate, silicon dioxide, and various suitable metals are sequentially added and patterned to make three-dimensional structures. The use of either of the above methods requires clean room facilities and careful quality control processes. Consequently, the micro-pumps including the silicon diaphragm are high in material cost and expensive to manufacture. The high cost may be prohibitive for disposable use. A cheaper alternative to these micro-pumps is thus desirable, especially for disposable use in bio-analysis applications.

Furthermore, the silicon diaphragm has a very high Young's modulus of about 100 Gpa. A micro-pump having such a diaphragm generally has a low compression ratio, which is defined by:

$$\epsilon=(\Delta V+V_0)/V_0$$

where ΔV is the stroke volume, and $V_0$ is the dead volume, which is a volume of fluid that is not displaced in a pumping chamber during a pumping cycle.

A low compression ratio is disadvantageous for a micro-pump where self-priming is concerned. To achieve self-priming in a micro-pump, i.e. to be able to pump as much gas and gas bubbles out of the micro-pump, the compression ratio needs to be maximized. To maximize compression ratio, the dead volume must be minimized while the stroke volume maximized. This maximizing of a stroke volume of a micro-pump having a silicon diaphragm is not easily achieved, especially if the micro-pump has a pumping chamber with angular profiles and/or the diaphragm is driven with an actuator, such as a piezo element that is capable of generating only a limited actuation force. Such a micro-pump may exhibit a relatively large dead volume due to a mismatch between the shapes of the silicon diaphragm and the pumping chamber.

K. P. Kamper, J. Dopper, W. Ehrfeld, and S. Oberbeck, "A self-filling low-cost membrane micro-pump", *The* 11$^{th}$ *annual international workshop on MEMS*. 1998, Heidelberg Germany, pp.432-43, discloses a micro-pump having a layered construction that has a relatively high compression ratio. This micro-pump includes top and bottom molded polycarbonate housing parts that include microstructures formed therein that serve as inlet and outlet valves and alignment structures. A polycarbonate valve membrane separates the top and bottom parts. The micro-pump also includes a pump membrane, which is separate from the valve membrane. The pump membrane is mounted on top of the upper housing part. Fluidic connection between a space underneath the pump membrane and a valve plane where the valve membrane is located is achieved by two cylindrical through-holes in the upper housing part.

SUMMARY

According to an embodiment of the invention, there is provided a micro-pump. The micro-pump includes a first layer, a second layer and a third intermediate flexible layer. The first layer includes an inlet recess, an inlet channel in fluid communication with the inlet recess and an outlet channel. The second layer includes an outlet and an inlet. The first layer and the second layer are disposed such that the inlet is opposite the inlet recess and at least a portion of the outlet channel is opposite the outlet. At least one of the first layer and the second layer includes a pumping chamber in fluid communication with the inlet channel and the outlet channel. The intermediate flexible layer includes an inlet slit and an outlet slit positioned therein. The intermediate flexible layer also includes an actuatable portion, a first valve portion adjacent the inlet slit and a second valve portion adjacent the outlet slit. The actuatable portion abuts the pumping chamber. The first valve portion is disposed over the inlet to block fluid passage between the inlet and the inlet recess. The first valve portion is moveable away from the inlet in response to a first actuation of the actuatable portion to allow the inlet to be in fluid communication with the inlet recess through the inlet slit. The second portion is disposed between the outlet channel and the outlet so as to block fluid passage between the outlet channel and the outlet. The second valve portion is moveable away from the outlet channel in response to a second actuation of the actuatable portion to allow the outlet channel to be in fluid communication with the outlet through the outlet slit.

The pumping chamber may be defined by two respective pumping recesses in the first layer and the second layer. In such a case, the actuatable portion of the intermediate flexible layer is arranged between the pumping recesses. The inlet of the second layer may include a recess surrounding a pedestal, the pedestal being in abutment with the inlet slit of the intermediate flexible layer. The outlet channel of the first layer may include a recess surrounding a pedestal, the pedestal being in abutment with the outlet slit of the intermediate flexible layer.

The structure of the first layer and the second layer, for the above-described embodiment, are largely identical and may therefore be molded using a single mold. Accordingly, the pump of the invention can be manufactured cost-effectively and by a relatively simple process. The features peculiar to the first layer and the second layer may then be formed in the respective layers after the layers are molded.

The intermediate flexible layer may be made of any material that has a flexibility sufficient for actuation to ensure the transport of liquid through the pump. For example, it can be made out of a thin metal foil, of a thin film of a semiconductor, such as silicon, or of a polymeric material. A suitable intermediate layer is a membrane layer of a low Young's modulus. With such a layer, the actuatable portion of the intermediate flexible layer may be closely urged against the wall of the pumping chamber to increase the compression ratio of the micro-pump. The intermediate flexible layer may be at least substantially flat. Such a layer is easy to manufacture.

BRIEF DESCRIPTION OF DRAWINGS

The invention will be better understood with reference to the drawings, in which.

DETAILED DESCRIPTION

Figure 1:
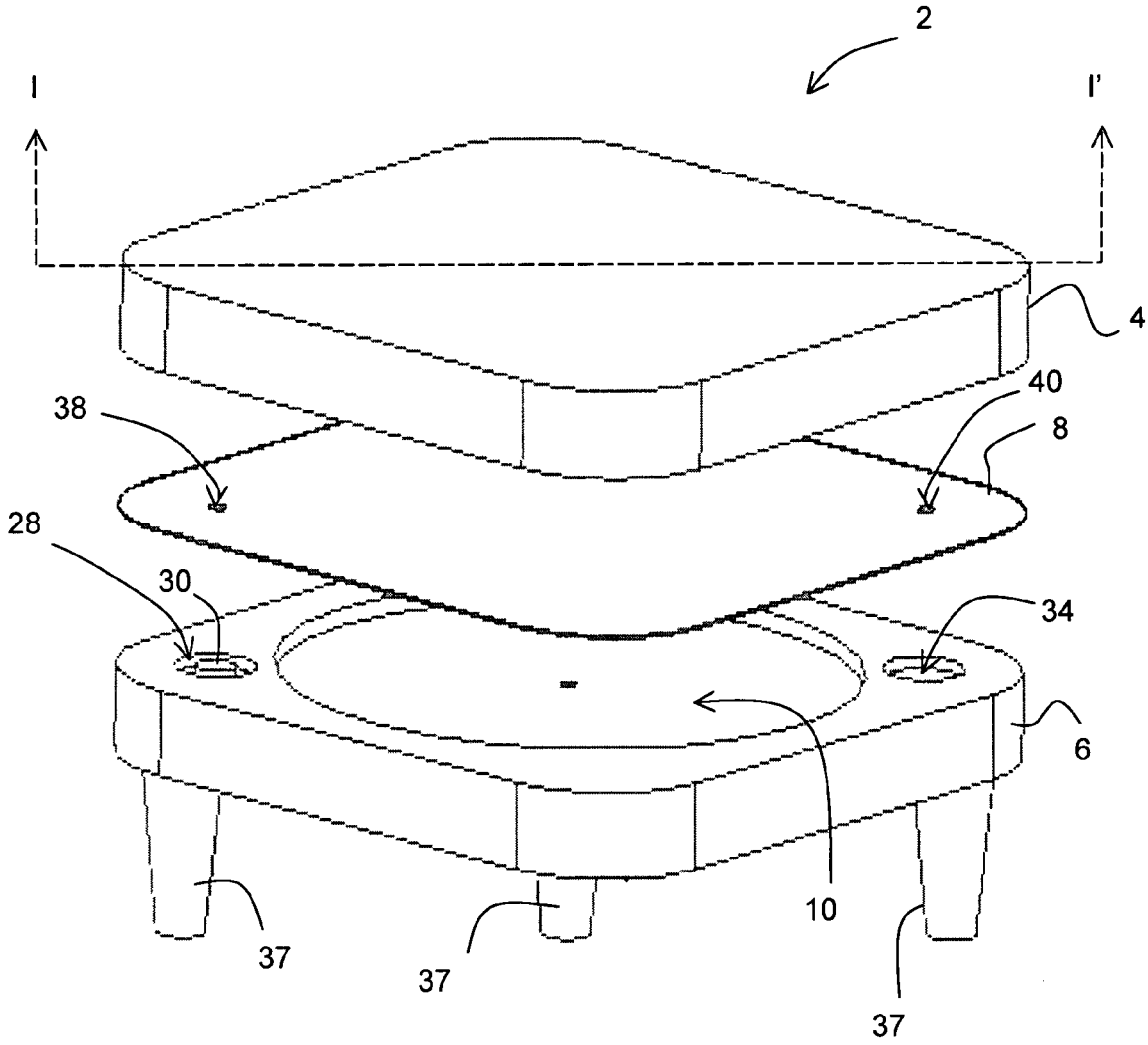
FIG. 1 is an exploded isometric drawing of a micro-pump according to an embodiment of the invention, wherein the micro-pump includes a top layer, an intermediate layer and a bottom layer.
Figure 2:
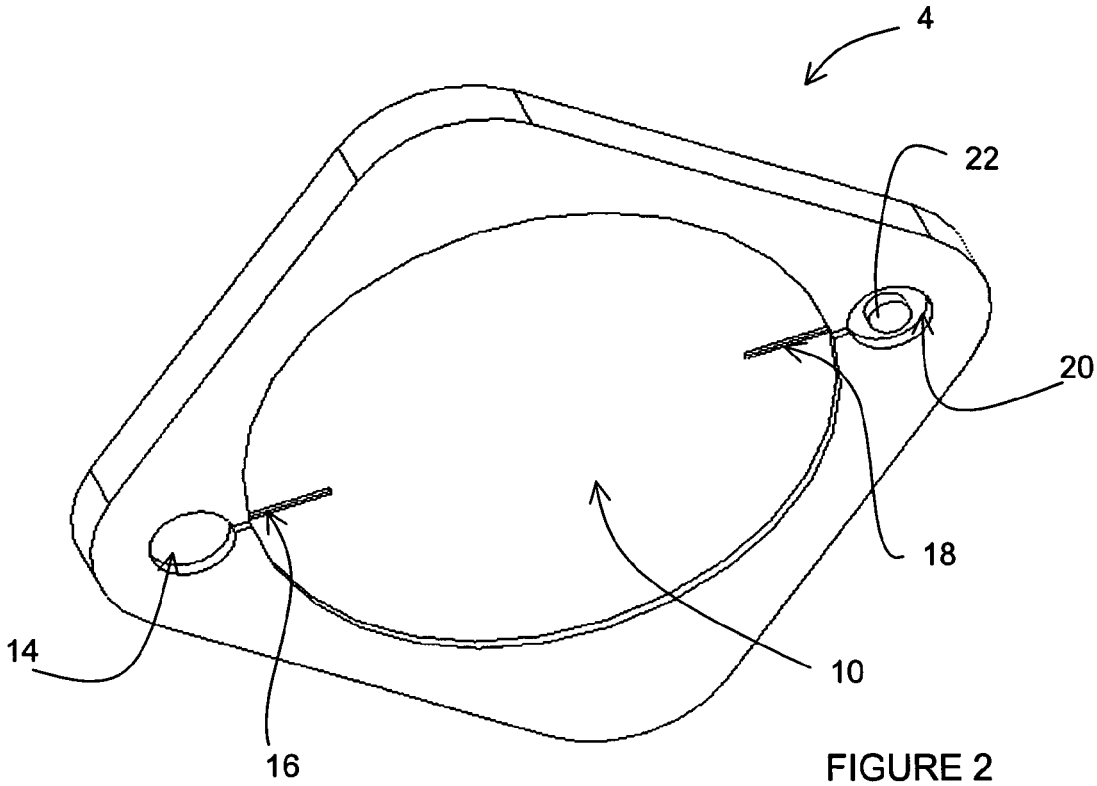
FIG. 2 is an isometric drawing showing an undersurface of the top layer in FIG. 1.
Figure 3A:
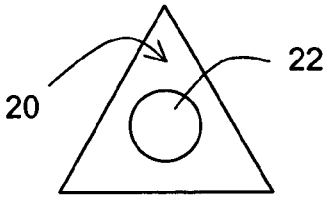
FIGS. 3A-3E are drawings showing plan views of an annular recess surrounding a pedestal on the undersurface of the top layer in FIG. 2, the annular recess and the pedestal are shown in different shapes.
Figure 3B:
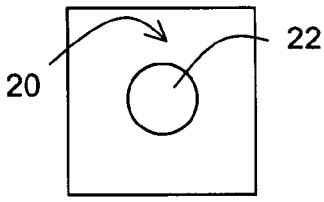
Figure 3C:
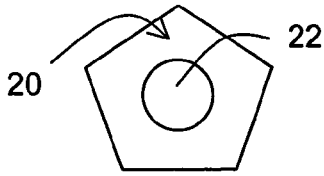
Figure 3D:
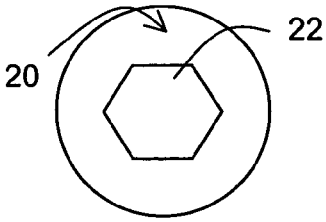
Figure 3E:
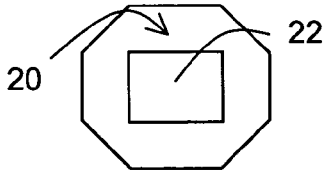
Figure 5A:
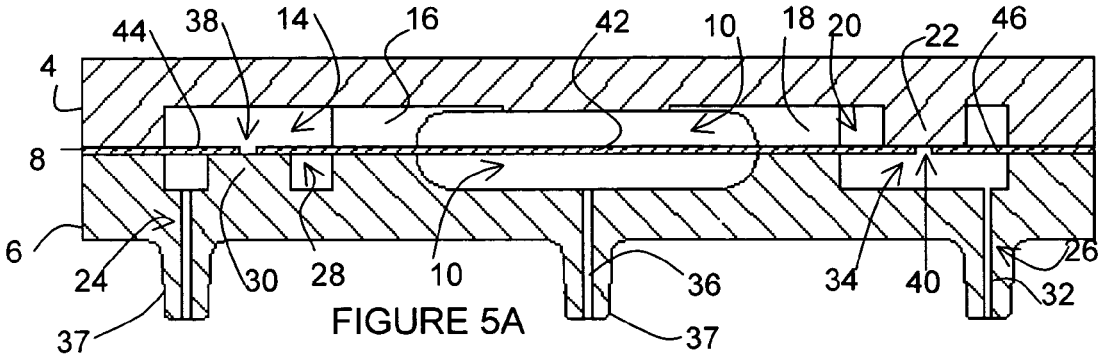
FIG. 5A is a sectioned drawing of the micro-pump in FIG. 1, taken along line I-I in FIG. 1, wherein the micro-pump is shown assembled and in a non-actuated state.

FIG. 1 is an exploded isometric drawing of a micro-pump 2 according to an embodiment of the invention. The micro-pump 2 includes a first or top housing layer 4, a second or bottom housing layer 6 and a third intermediate flexible layer 8 sandwiched between the top layer 4 and the bottom layer 6 to define a three-layer structure having a total thickness or height of, for example, between 2-5 mm. FIG. 2 is an isometric drawing showing an underside of the top housing layer 4. At least one of the top layer 4 and the bottom layer 6 includes a pumping recess 10 that defines a pumping chamber 12 (FIG. 5B) of the micro-pump 2. This pumping chamber 12 may have a height of, but not limited to, for example 200 μm. The pumping chamber 12 may have a diameter of, but not limited to, for example 3-10 mm. In the micro-pump 2 shown in FIG. 1, the top layer 4 and the bottom layer 6 have respective pumping recesses 10. When disposed opposite each other, these pumping recesses 10 define the pumping chamber 12. The top layer 4 includes an inlet recess 14 and an inlet channel 16 that connects the inlet recess 14 to the pumping recess 10 to allow fluid communication therebetween. The inlet recess 14 may be, but not limited to, 0.5-2 mm in diameter. The top layer 4 also includes an outlet channel 18 that is in fluid communication with the pumping recess 10. The outlet channel 18 includes a first annular recess 20 that surrounds a first pedestal 22 of the top layer 4. The bottom layer 6 includes an inlet 24 (FIG. 5A) and an outlet 26 (FIG. 5A). The inlet 24 of the bottom layer 6 includes a second annular recess 28 that surrounds a second pedestal 30 of the bottom layer 6. It should be noted that the shapes of the first and second annular recesses 20, 28 and the first and second pedestals 22, 30 are not restricted to a cylindrical shape as shown in FIGS. 1 and 2. Other shapes as shown in FIGS. 3A-3E are also possible. The outlet 26 includes a narrow portion 32 connected to a bulbous or wider outlet recess 34. The bottom layer 6 further includes a through-hole 36 that is in fluid communication with the pumping recess 10.

Figure 4:
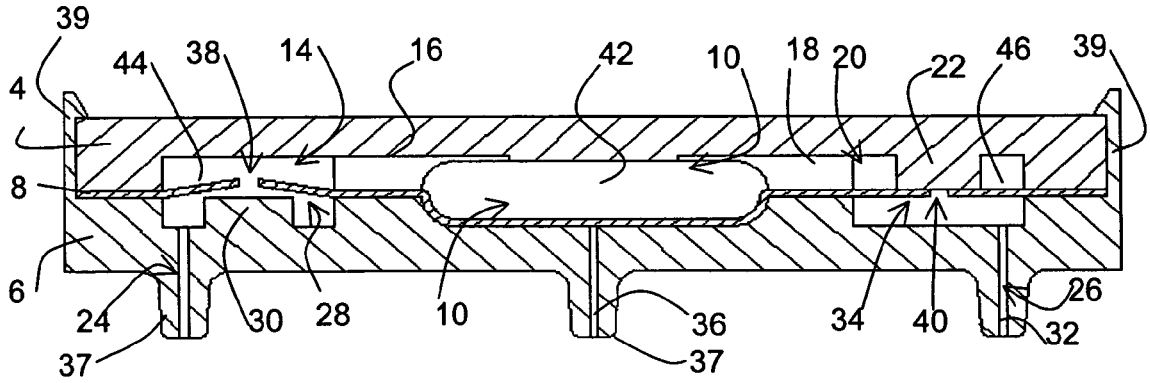
FIG. 4 is a sectioned drawing of a micro-pump similar to the micro-pump in FIG. 1, showing the top layer snap-fitted to the bottom layer.

The top layer 4 and the bottom layer 6 are arranged or disposed on either side of the intermediate flexible layer 8 such that the inlet 24, or more specifically the second annular recess 28, of the bottom layer 6 is opposite the inlet recess 14 of the top layer 4. Also in this arrangement of the top and the bottom layers 4, 6, at least a portion of the outlet channel 18, or more specifically the first annular recess 20, is disposed opposite the outlet recess 34 of the bottom layer 6. The top layer 4 is fixed to the bottom layer 6 to compress the intermediate flexible layer 8 therebetween. FIG. 4 shows an example of how the top layer 4 may be fixed to the bottom layer 6. In this example, the bottom layer 6 is provided with at least two latching arms 39 protruding from a surface thereof to allow the bottom layer 6 to be snap-fitted to the top layer 4. Other means of attaching the top layer 4 to the lower layer 6 include, but are not limited to, gluing, such as with a quick curing type of adhesive, screwing and clamping. The assembly of the top layer 4 to the lower layer 6 allows voids, such as the recesses 10, 14, 20 of the top layer 4 to be hermetically sealed for operating the micro-pump 2. The operation of the micro-pump 2 will be described shortly. The top layer 4 and the bottom layer 6 may include alignment structures (not shown) that allow the top layer 4 to be aligned with the bottom layer 6 during assembly. The bottom layer 6 may also include integral tube connectors 37.

Figure 12:
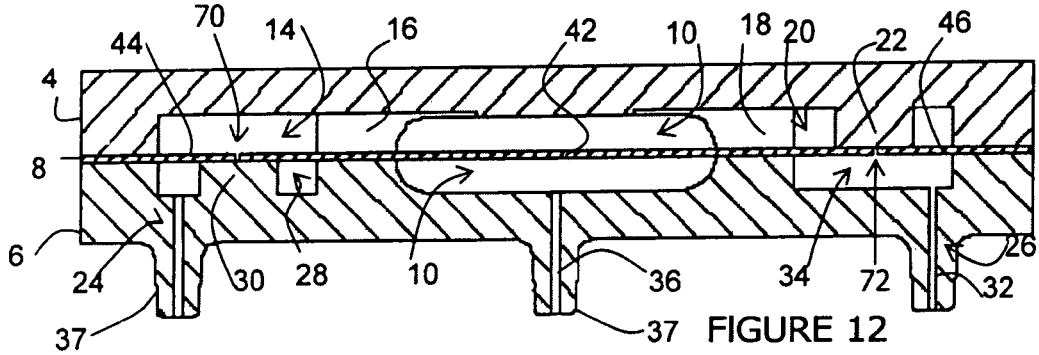
FIG. 12 is a sectional view of an alternative embodiment of the micro-pump in FIG. 1, taken along line I-I in FIG. 1, wherein the micro-pump is shown assembled and in a non-actuated state.

The intermediate flexible layer 8 includes an inlet hole 38 and an outlet hole 40 defined therethrough or positioned therein. The inlet hole 38 and outlet hole 40 may have a diameter of, but not limited to, between 0.05 mm to 0.5 mm. It should be noted that slits such as 70 and 72*i* (shown in FIG. 12) instead of holes 38, 40 would also work. Such slits may have a dimension of 0.05-0.2 mm by 0.05-0.2 mm. The intermediate flexible layer 8 also includes an actuatable portion 42 (FIG. 5A) that is clamped in place by a periphery of the top layer 4 and the bottom layer 6. When arranged or disposed between the top layer 4 and the bottom layer 6, the actuatable portion 42 abuts the pumping chamber 12. In the case when both the top layer 4 and the bottom layer 6 include a pumping recess 10 each as described above, the actuatable portion 42 is arranged between the respective pumping recesses 10 of the top layer 4 and the bottom layer 6 to be in the middle of the pumping chamber 12 defined by the pumping recesses 10. The intermediate flexible layer 8 further includes a first valve portion 44 adjacent, in this particular embodiment surrounding, the inlet hole 38. When assembled between the top layer 4 and the bottom layer 6, this first valve portion 44 is disposed, with a slight bias, over the annular recess 28 with the inlet hole 38 seated on or abutting the second pedestal 30 to block fluid passage between the inlet 24 and the inlet recess 14. The second pedestal therefore function as a valve seat for the first valve portion 44 thereabove. The first valve portion 44 of the intermediate flexible layer 8 is moveable away from the annular recess 28 into the inlet recess 14 of the top layer 4 in response to a first actuation of the actuatable portion 42 to allow the inlet 24 to be in fluid communication with the inlet recess 14 through the inlet hole 38.

The intermediate flexible layer 8 further includes a second valve portion 46 adjacent, in this particular embodiment surrounding, the outlet hole 40. When assembled between the top layer 4 and the second layer 6, the second valve portion 46 is disposed between the first annular recess 20 and the outlet recess 34, with a slight bias, to be seated on or abutting the first pedestal 22 so as to block fluid passage between the outlet channel 18 and the outlet 26. The first pedestal 22 therefore function as a valve seat for the second valve portion 46. With this second valve portion 46 abutting its respective valve seat, backflow of fluid through the micro-pump 2, which is undesirable for most bio-analysis applications, can be prevented. The second valve portion 46 is moveable away from the annular recess 20 into the outlet recess 34 of the bottom layer 6 in response to a second actuation of the actuatable portion 42 to allow the outlet channel 18 to be in fluid communication with the outlet 26 through the outlet hole 40. The intermediate flexible layer 8 may be a unitary layer for ease of assembly. This layer may be at least substantially flat.

The top and bottom housing layers 4, 6 may be fabricated using any rigid material that is biocompatible for bio-analysis applications, such as silicon or plastics (e.g., thermoplastics). Examples of thermoplastics include, but are not limited to, polycarbonate, poly(meth)acrylate, polyoxymethylen, polyamide, polybutylenterephthalat, and polyphenylenether. When made of such thermoplastics, the top housing layer 4 and the lower housing layer 6 may be fabricated using injection molding, hot embossing or other suitable operations. It should be noted that the structure of the top layer 4 and the bottom layer 6 are, in this particular embodiment, largely identical and may therefore be molded using a single mold. The features peculiar to the top layer 4 and the bottom layer 6 can then be formed in the respective layers 4, 6 after the layers 4, 6 are molded. For example, the inlet channel 16 and the outlet channel 18 may be formed using a saw. The inlet 24, outlet 32 and the through-hole 36 in the lower layer 6 may be laser drilled using a conventional Nd:YAG laser in Q-switched mode.

The intermediate flexible layer 8 may be made of silicon or a polymeric material, such as one selected from polycarbonate, polyacrylic, polyoxymethylen, polyamide, polybutylenterephthalat and polyphenylenether. Alternatively, the intermediate layer may also be a membrane layer, such as a polydimethylsiloxane (PDMS), MYLAR®, polyurethane, polyvinylidene fluoride (PVDF), and flourosilicone membrane layer. If not commercially available, the membrane (or the intermediate layer, in general) can be made by any method known to those skilled in the art. Its manufacture is exemplified by the following process of fabricating a PDMS membrane layer. A PDMS membrane layer may be fabricated by casting. In order to facilitate the separation of cast PDMS from a mold, an anti-sticking layer, such as a tridecafluoro-1,1,2,2-tetrahydroocty trichiorosilane layer available from Sigma-Aldrich Corporation, St. Louis, Mo., U.S.A., is applied onto the surface of a mold cavity of the mold by a vacuum evaporation method prior to casting. The process is referred to herein as silanization.

A two-part PDMS solution, such as Sylgard184 Silicon Elastomer available from Dow Corning, Midland, Mich., U.S.A., can be used for casting the membrane layer. Part A and B of the solution are mixed in a 10:1 ratio. The mixture is poured slowly into the silanized molding cavity. The mold is then placed inside a vacuum dessicator for about one hour to allow air bubbles trapped in the uncured PDMS mixture to escape. Once there is no visible air bubble in the PDMS mixture, a smooth Teflon sheet is placed on top of the mold. Modest pressure is applied to the Teflon/PDMS/mold sandwich while curing to squeeze excess PDMS prepolymer out of the molding cavity. This process ensures that the cured PDMS membrane has a thickness that is approximately the depth of the molding cavity. The whole set up is then cured inside an oven at about 70° C. for about an hour. After curing, the Teflon plate is removed from the mold and the cured PDMS membrane layer is peeled off the molding cavity.

Figure 5B:
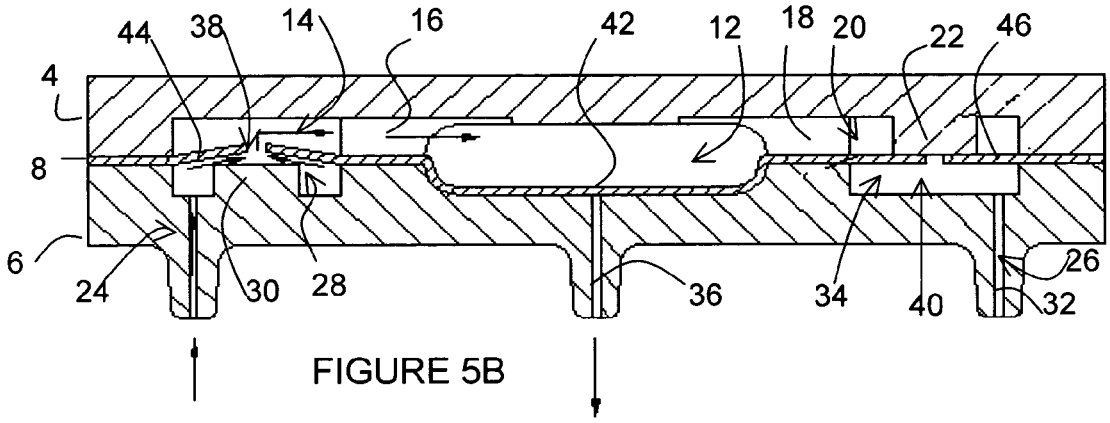
FIG. 5B is a sectioned drawing similar to FIG. 5A, wherein the micro-pump is shown in a first actuated state for drawing fluid through an inlet into a pumping chamber.
Figure 5C:
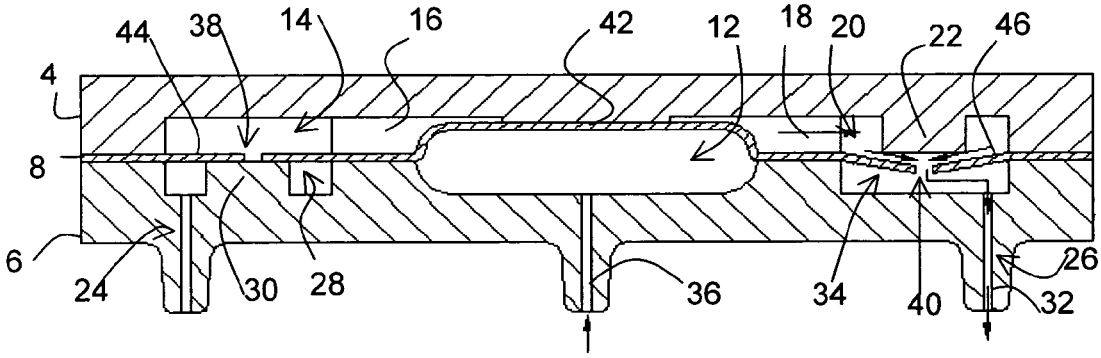
FIG. 5C is a sectioned drawing similar to FIG. 5A, wherein the micro-pump is shown in a second actuated state for expelling fluid out of the pumping chamber through an outlet.

The principle of operation of the micro-pump 2 is next described with the aid of FIGS. 5A, 5B and 5C. FIG. 5A shows the micro-pump 2,when it is not actuated. As described above, the first valve portion 44 and the second valve portion 46 of the intermediate flexible layer 8 are slightly biased to rest, in their closed positions, on their respective pedestals 30, 22 of the bottom layer 6 and the top layer 8. In these closed positions of the valve portions 44, 46, the pumping chamber 12 is substantially hermetically sealed to be considerably airtight.

During use, an inlet tube, an outlet tube and an actuation fluid tube are connected, such as by gluing, to the bottom housing layer 6 over the inlet 24, the outlet 26 and an opening of the through-hole 36 respectively. The inlet tube is connected to a reservoir filled with fluid to be dispensed using the micro-pump 2. The micro-pump 2 may be actuated by fluid, such as air that is alternately pumped into and drawn out of the pumping chamber 12 through the actuation fluid tube. The alternating action of pumping and drawing air from the pumping chamber causes the actuation portion 42 of the intermediate flexible layer 8 to reciprocate between the respective pumping recesses 10 of the top layer 4 and the bottom layer 6.

In a first actuation of the actuation portion 42, air is drawn out of the pumping chamber 12 to draw the actuation portion 42 into the pumping recess 10 of the bottom housing layer 6 as shown in FIG. 5B. This movement of the actuation portion 42 enlarges the volume of the pumping chamber 12 to generate an underpressure therein. Atmospheric pressure then forces fluid in the reservoir through the inlet 24 into the second annular recess 28 to cause a buildup of pressure in the second annular recess 28. The pressure differential between the second annular recess 28 and the pumping chamber 12 causes the input valve portion 44 to lift or move away from the second pedestal 30 to its open position to allow the fluid in the annular recess 28 to flow through the inlet hole 38 into the inlet recess 14 and eventually into the pumping chamber 12. During this first actuation of the actuation portion 42, atmospheric pressure presses the outlet valve portion 46 against the first pedestal 22 to prevent fluid in the pumping chamber 12 from escaping.

In a second actuation of the actuation portion 42, air is pumped into the pumping chamber 12 to push the actuation portion 42 towards the pumping recess 10 of the top housing layer 4 as shown in FIG. 5C. This movement of the actuation portion 42 reduces the volume of the pumping chamber 12 to exert pressure on the fluid therein. The buildup of pressure or overpressure in the pumping chamber 12, and thus the first annular recess 20, lifts or pushes the outlet value portion 46 to its open position to allow the fluid in the pumping chamber 12 to escape or be expelled from the pumping chamber 12. During this second actuation of the actuation portion 42, the pressure of the fluid in the pumping chamber 12 presses the inlet valve portion 44 against the second pedestal 30 to prevent fluid in the pumping chamber 12 from returning through the inlet hole 38 to the reservoir.

A prototype of the micro-pump 2, a setup for evaluating the performance of the prototype micro-pump 2 and evaluation results obtained are next described. The top housing layer 4 and the bottom housing layer 6 are fabricated from polycarbonate, which is a clear plastic, using a computer numerical control (CNC) machine with a 0.5 mm diameter cutter. A PDMS membrane layer obtained using the above described process is used as the intermediate flexible layer 8. The membrane layer may have a thickness of between 0.1 and 0.5 mm. The inlet hole 38 and outlet hole 40 are also molded when molding the membrane layer. The top housing layer 4, the bottom housing layer 6 with the flexible layer 8 therebetween are held in place by securing the top housing layer to the lower housing layer 6 using 1.6 mm diameter screws. When assembled into such a three-layer structure, the micro-pump 2 has outer dimensions of 19 mm by 12 mm by 4.2 mm.

Figure 6:
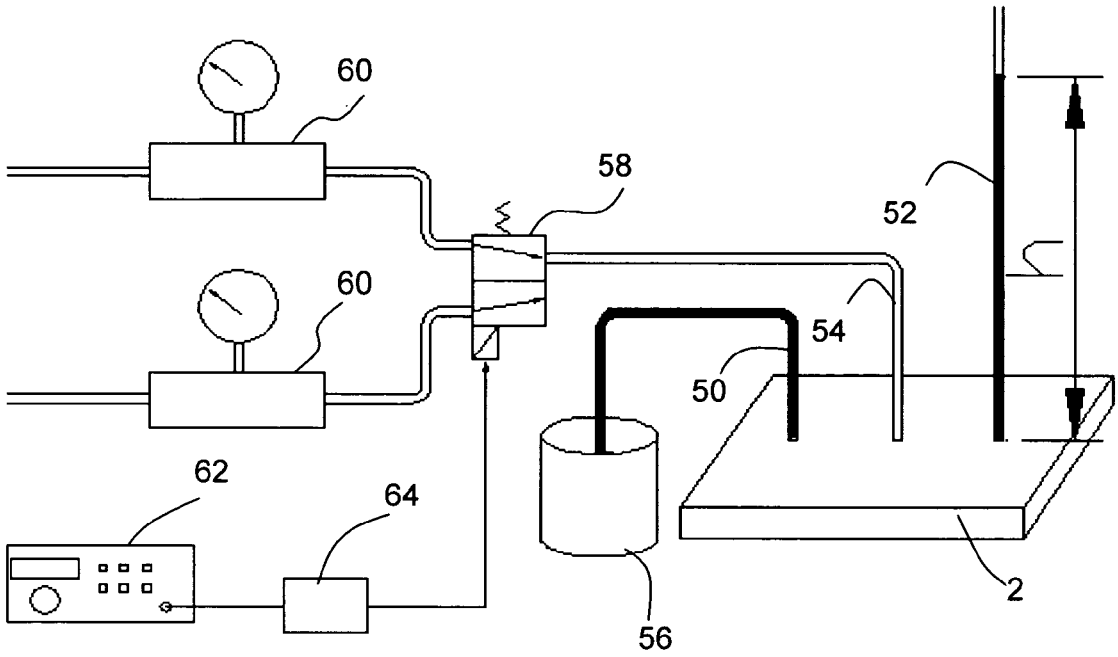
FIG. 6 is an experimental setup for evaluating the performance of a prototype micro-pump similar to that shown in FIG. 1.

An experimental set-up for testing the prototype micro-pump is illustrated in FIG. 6. Three tubes, each with an outer diameter of 1.5 mm were connected to the prototype micro-pump 2 to serve as a fluid inlet tube 50, a fluid outlet tube 52 and an air-supply tube 54. The fluid outlet tube 52 is straight and has a length of about 2.5 m and an inner diameter of 0.51 mm. The inlet tube 50 was connected to a reservoir 56 containing de-ionized filtered water. The air-supply tube 54 was connected to an output of a two-state three-way miniaturized solenoid valve 58, such as valve model 161T032 available from Nresearch Inc., New Jersey, U.S.A. The inputs of the solenoid valve 58 were connected to two pressure regulators 60 that are connected to a compressed air source (not shown) and a vacuum source (not shown) respectively for actuating the micro-pump 2. The pressure regulators 60 were adjusted so as to regulate the pressure of flowing air in the air-supply tube 52 to maintain respective predetermined pressures in the pumping chamber 12. The solenoid valve 58 was connected to a function generator 62 via a driver board 64. The function generator 62 controls the driving frequency of the solenoid valve 58 and thus the micro-pump 2.

The driving frequency was set initially at 0.25 Hz and thereafter adjusted between 0.5 and 6.5 Hz in steps of 0.5 Hz. At each driving frequency, the micro-pump 2 is exercised or actuated for a predetermined period. The length traversed by a liquid column in the fluid outlet tube 52 during the period is measured. This length is also known as the pump head of the micro-pump 2. This pump head is given by the height of the liquid column measured from the surface of fluid in the reservoir 56 (roughly indicated as "h" in FIG. 6). With the known inner diameter of the fluid outlet tube 52, the length of the liquid column and the predetermined period, the flow rate at each driving frequency was calculated.

Figure 7:
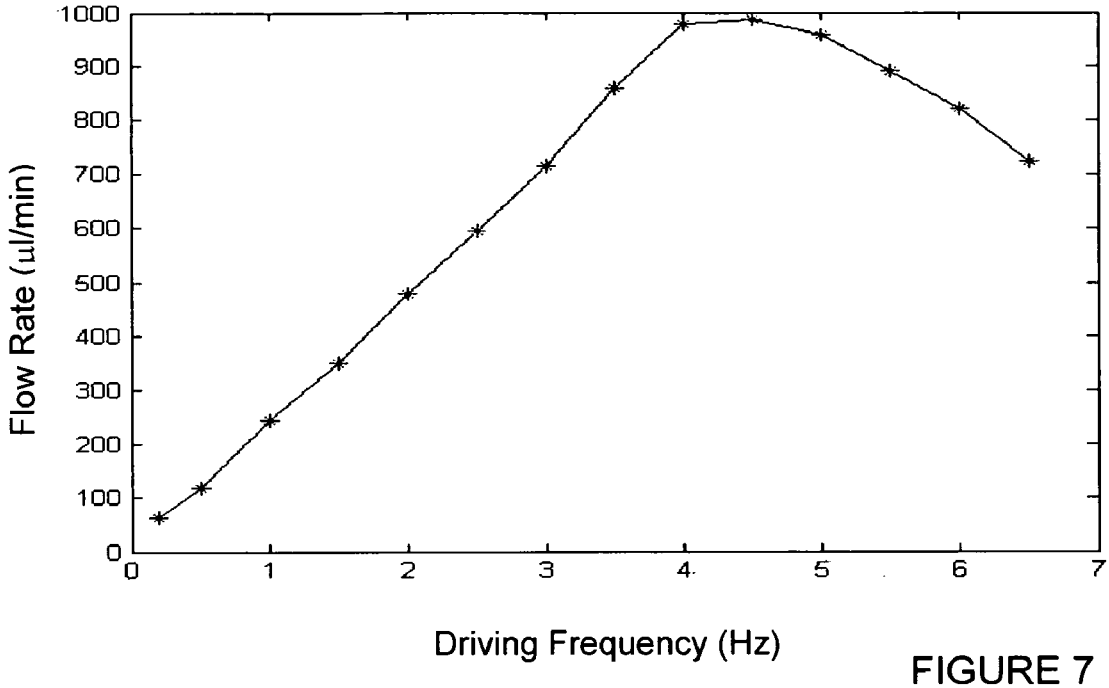
FIG. 7 is a graph of flow rate against driving frequency of the prototype micro-pump obtained using the experimental setup in FIG. 6.

FIG. 7 shows a fluid flow measurement, where the pump rate or flow rate as a function of the driving frequency was calculated and plotted. As can be seen from FIG. 7, the flow rate is substantially linear up to a driving frequency of about 4.0 Hz. A maximum flow rate of 988 μl/min was obtained when the driving frequency is between 4 Hz and 5 Hz. It should be noted that although the measurement was carried out with a highest driving frequency of about 7 Hz, higher driving frequencies are achievable with intermediate flexible layers of other materials which are mentioned above.

Figure 8:
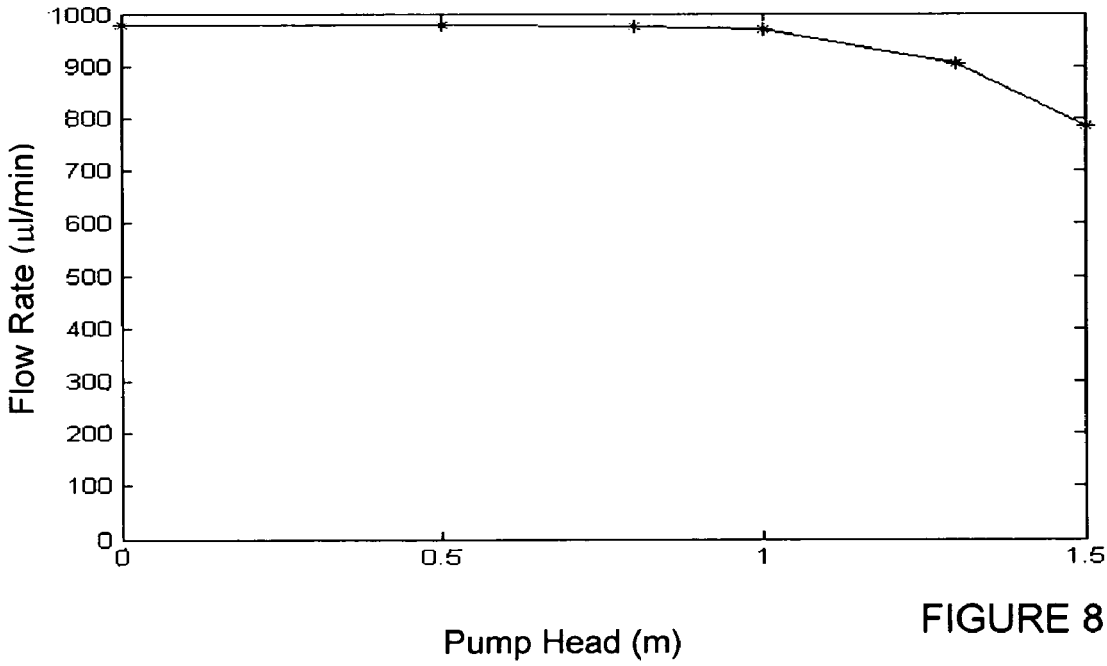
FIG. 8 is a graph of flow rate against pump head of the prototype micro-pump obtained using the experimental setup in FIG. 6.

The flow rate versus pressure characteristic at a driving frequency of 4 Hz is shown in FIG. 8. This characteristic is obtained by connecting a long tube, having an outer diameter of 1.5 mm and an inner diameter of 0.8 mm, horizontally to the outlet 26 of the micro-pump at various pump head positions, specifically at pump head positions of 0, 0.5, 1.0 and 1.5 m. The flow rate is determined by measuring the distance along the tube traversed by fluid therein. From the results obtained, as shown in FIG. 8, the flow rate appears not to be very sensitive to the output pressure. A back flow test was also conducted after the micro-pump 2 was actuated to produce a liquid column of about 2 m pump head. When the water reached that pump head, the actuation of the micro-pump 2 was stopped to leave the micro-pump 2 in what is referred to as a relaxation mode. Substantially no back flow was observed for twelve hours after actuation of the micro-pump 2 was stopped. A reliability test for the micro-pump 2 was also conducted. The micro-pump 2 was actuated for a continuous 168 hours (a week). The micro-pump 2 was observed to still be working well after the period, i.e. the micro-pump did not fail during that period. Furthermore, the performance of the micro-pump 2 remained the same after the reliability test.

The micro-pump 2 was also tested for the delivery of cell and tissue debris-containing solution. The test solution was prepared by digesting rat liver tissues in a digestion reagent. Hence, the test solution contained digestion reagent, PBS buffer, rat liver cells and debris. The size of the cells was 7-12 μm in diameter and the debris ranges from 70 μm to 138 μm in size. It was observed that there was no blockage of the micro-pump 2 during the test.

Figure 9:
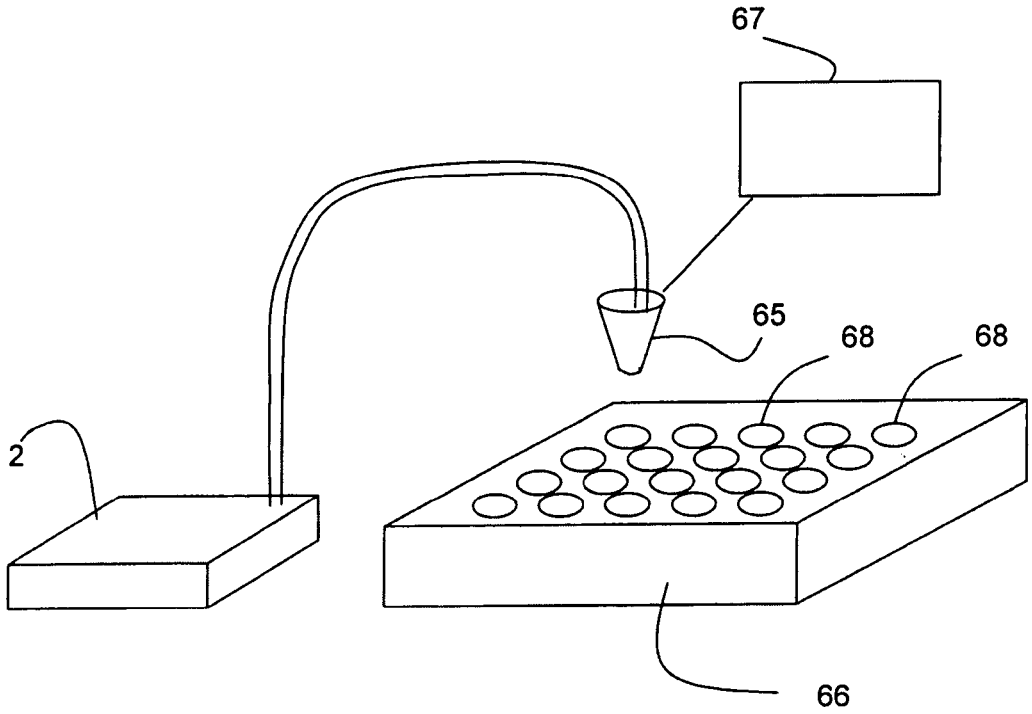
FIG. 9 is a schematic diagram showing an application of the micropump in FIG. 1.

FIG. 9 shows an exemplary application of the micro-pump 2 in biomedical research. The micro-pump 2 is connected to a liquid dispensing system such as a pipette 65 that is moveable in an x-y direction over a biochip 66 under the control of a pipette robot 67. The biochip 66 is a glass or silicon substrate with cavities or spots 68 in which nucleic acid such as oligonucleotides (not shown) can be immobilized in order to carry out nucleic acid hybridization assays. The micro-pump 2 can be used to transport all liquids and reagents necessary in the assay to the cavities 68.

Advantageously, the three-layer micro-pump 2 according to the embodiment described above is low in cost. The top and bottom housing layers 4, 6 may be of polycarbonate and the intermediate flexible layer 8 may be of a PDMS membrane. Such materials are a lot less expensive compared to silicon used in prior art micro-pumps. Silicon is known to cost as much as fifty times more than most plastics. Fabrication methods for these materials are also less complex, and thus cheaper to perform compared to those required for processing a silicon wafer. A PDMS intermediate flexible layer has a very low Young's modulus, a high elongation property, is biocompatible and provides good sealing of the top and bottom housing layers. Thus, the problem of sealing which may plague the prior art micro-pumps using a silicon layer as a diaphragm is overcome with the use of the PDMS membrane layer. Moreover, the PDMS membrane also allows the micro-pump to have a higher compression ratio as compared to micro-pumps having a silicon diaphragm. Furthermore, the PDMS membrane may be over actuated by pneumatic means to be urged against the walls of the pumping chamber. In this manner, the stroke volume of the pump is about the volume of the pumping chamber. In other words, the dead volume of the pump is small. From experimental results obtained for the prototype micro-pump, it is found that the micro-pump is robust and is able to pump liquid even when the pump chamber is full of air, i.e. the prototype micro-pump is self-priming. It is also found that the operation of the prototype micro-pump is not affected by gas bubbles trapped in the pumping chamber but is able to expel the gas bubbles, i.e. the micro-pump is bubble-tolerant. The flow rate of the micro-pump is also found not to be sensitive to the pumping media viscosity, outlet pressure and inlet pressure. The prototype micro-pump is able to pump gas from the inlet to the outlet even when the pump head reached more than 2 m. With the valve structures substantially co-planar with the pumping chamber, the micro-pump is also thinner as compared to the prior art micro-pumps.

Figure 10:
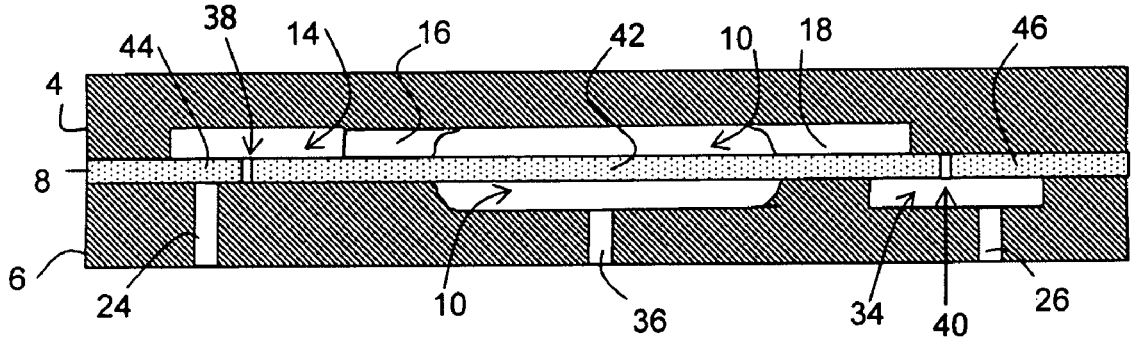
FIG. 10 is a sectioned drawing of a micro-pump according to another embodiment of the invention.

Although the invention is described as implemented in the above-described embodiment, it is not to be construed to be limited as such. For example, it is not necessary that annular recesses surrounding a pedestal be provided for the invention to work, although such a feature allows pressure to be substantially evenly distributed around the valve portion adjacent the pedestal. FIG. 10 shows a cross-sectional view of an alternative embodiment of a micro-pump without such annular recesses. In this micro-pump, the inlet in the bottom layer is directly opposite the inlet recess of the top layer. A portion of the outlet channel in the top layer is also directly opposite the outlet recess of the lower layer.

As another example, the through-hole for actuating the actuatable portion of the intermediate flexible layer may be formed in the top layer instead of the bottom layer as described above.

Figure 11:
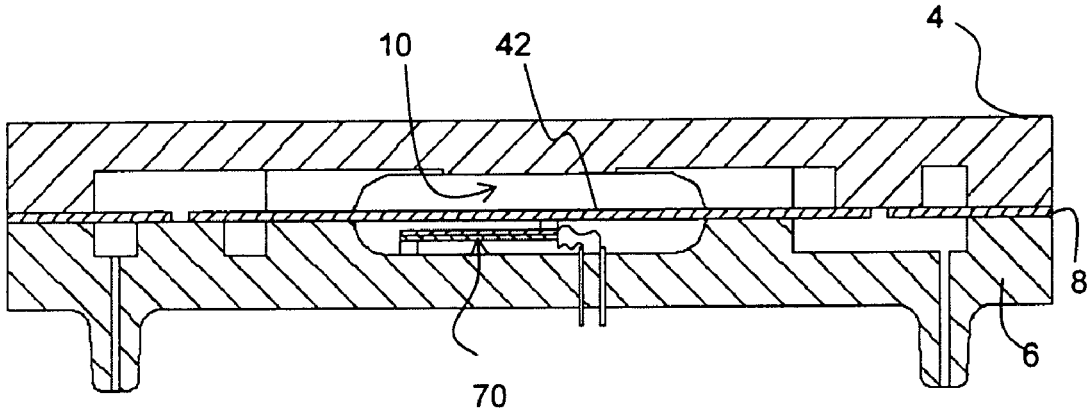
FIG. 11 is a sectioned drawing similar to 5A showing a bimorph PZT cantilever disposed within the pumping chamber for actuating the micro-pump.

As yet another example, although a pneumatic means is described above for actuating the micro-pump, other actuators known to those skilled in the art may also be used. For example, a bimorph PZT cantilever 70 may be disposed within the pumping chamber 12 as shown in FIG. 11 for actuating the actuatable portion 42 of the intermediate flexible layer 8. A first end of the cantilever 70 is fixed to a wall of the pumping chamber 12 while a second free end of the cantilever 70 is attached to the actuatable portion 42. When a voltage is applied to the cantilever 70, the free end of the cantilever moves away from the pumping chamber wall to push the actuatable portion 42 in a direction so as to reduce the volume of the pumping chamber 12. When the voltage is removed from the cantilever 70, the free end collapses, dragging the actuatable portion 42 with it to increase the volume of the pumping chamber. In this manner, a reciprocating movement of the actuatable portion within the pumping chamber is achieved.

We claim:

1. A micro-pump comprising:

a first layer having:

an inlet recess;

an inlet channel in fluid communication with the inlet recess; and an outlet channel;

a second layer having:

an outlet; and an inlet;

wherein the first layer and the second layer are disposed such that the inlet is opposite the inlet recess and at least a portion of the outlet channel is opposite an outlet recess and wherein at least one of the first layer and the second layer includes a pumping chamber in fluid communication with the inlet channel and the outlet channel; and a third intermediate flexible layer having:

an inlet slit and an outlet slit positioned therein;

an actuatable portion abutting the pumping chamber;

a first valve portion adjacent the inlet slit, wherein the first valve portion is disposed over the inlet to block fluid passage between the inlet and the inlet recess and wherein the first valve portion is moveable away from the inlet in response to a first actuation of the actuatable portion to allow the inlet to be in fluid communication with the inlet recess through the inlet slit; and a second valve portion adjacent the outlet slit, wherein the second valve portion is disposed between the outlet channel and the outlet so as to block fluid passage between the outlet channel and the outlet and wherein the second valve portion is moveable away from the outlet channel in response to a second actuation of the actuatable portion to allow the outlet channel to be in fluid communication with the outlet through the outlet slit;

wherein the inlet of the second layer comprises a recess surrounding a pedestal, the pedestal being in abutment with the inlet slit of the intermediate flexible layer; and wherein a through-hole is defined in one of the first layer and the second layer to be in fluid communication with the pumping chamber.

2. A micro-pump according to claim 1, wherein the pumping chamber is defined by two respective pumping recesses in the first layer and the second layer, and wherein the actuatable portion of the intermediate flexible layer is arranged between the pumping recesses.

3. A micro-pump according to claim 1, wherein the outlet channel of the first layer comprises a recess surrounding a pedestal, the pedestal being in abutment with the outlet slit of the intermediate flexible layer.

4. A micro-pump according to claim 1 wherein the inlet slit and the outlet slit are respective through-holes in the intermediate flexible layer.

5. A micro-pump according to claim 1, wherein the intermediate flexible layer comprises a polymeric material.

6. A micro-pump according to claim 5, wherein the polymeric material is selected from the group consisting of polycarbonate, polyacrylic, polyoxymethylen, polyamide, polybutylenterephthalat and polyphenylenether.

7. A micro-pump according to claim 5, wherein the intermediate flexible layer is a membrane.

8. A micro-pump according to claim 7, wherein the membrane comprises a material selected from the group consisting of polydimethylsiloxane, MYLAR®, polyurethane fluoride, and flourosilicone.

9. A micro-pump according to claim 1, wherein the intermediate flexible layer is a unitary layer.

10. A micro-pump according to claim 1, wherein the intermediate flexible layer is at least substantially flat.

11. A micro-pump according to claim 1, wherein the first layer and the second layer are molded.

12. A micro-pump comprising:

a first layer having:

an inlet recess;

an inlet channel in fluid communication with the inlet recess; and an outlet channel;

a second layer having:

an outlet; and an inlet;

wherein the first layer and the second layer are disposed such that the inlet is opposite the inlet recess and at least a portion of the outlet channel is opposite an outlet recess and wherein at least one of the first layer and the second layer includes a pumping chamber in fluid communication with the inlet channel and the outlet channel; and a third intermediate flexible layer having:

an inlet slit and an outlet slit positioned therein;

an actuatable portion abutting the pumping chamber;

a first valve portion adjacent the inlet slit, wherein the first valve portion is disposed over the inlet to block fluid passage between the inlet and the inlet recess and wherein the first valve portion is moveable away from the inlet in response to a first actuation of the actuatable portion to allow the inlet to be in fluid communication with the inlet recess through the inlet slit; and a second valve portion adjacent the outlet slit, wherein the second valve portion is disposed between the outlet channel and the outlet so as to block fluid passage between the outlet channel and the outlet and wherein the second valve portion is moveable away from the outlet channel in response to a second actuation of the actuatable .portion to allow the outlet channel to be in fluid communication. with the outlet through the outlet slit;

wherein the outlet channel of the first layer comprises a recess surrounding a pedestal, the pedestal being in abutment with the outlet slit of the intermediate flexible layer; and wherein a through-hole is defined in one of the first layer and the second layer to be in fluid communication with the pumping chamber.

* * * * *